US005584150A

United States Patent [19]

Newman

[11] Patent Number: 5,584,150

[45] Date of Patent: Dec. 17, 1996

[54] ANGLE IRON COVER

[76] Inventor: William Newman, 8325 Old Bainbridge Rd., Tallahassee, Fla. 32303

[21] Appl. No.: 403,282

[22] Filed: Mar. 13, 1995

(Under 37 CFR 1.47)

[51] Int. Cl.[6] ..... E04C 3/02; E06B 1/04

[52] U.S. Cl. ..... 52/204.2; 52/211; 52/302.6; 52/716.2; 52/717.01; 52/718.04; 52/734.1; 52/738.1

[58] Field of Search ..... 52/204.2, 204.53, 52/204.54, 211, 734.1, 738.1, 716.1, 716.6, 717.01, 717.03, 717.04, 717.05, 717.06, 204.1, 204.5, 212, 214, 216, 718.04, 716.2, 302.6; 49/504, DIG. 2

[56] References Cited

U.S. PATENT DOCUMENTS

| | | | |
|---|---|---|---|
| 1,984,134 | 12/1934 | Himmel et al. | 52/738.1 X |
| 2,131,115 | 9/1938 | Naisuler | 52/738.1 X |
| 2,293,793 | 8/1942 | Bawtenheimer | 52/204.5 |
| 2,510,845 | 6/1950 | Waters et al. | 49/460 |
| 2,851,742 | 9/1958 | Johnston | 52/204.53 |
| 3,130,455 | 4/1964 | Borlenghi . | |
| 3,478,478 | 11/1969 | Luebs | 52/718.04 X |
| 3,742,668 | 7/1973 | Oliver | 52/512 X |
| 4,363,507 | 12/1982 | Bays | 52/717 X |
| 4,423,575 | 1/1984 | Lagergren et al. | 52/204.53 |
| 4,793,115 | 12/1988 | Horgan, Jr. | 52/738.1 |
| 4,947,606 | 8/1990 | La See | 52/734.1 X |
| 5,011,022 | 4/1991 | Gibbs | 198/497 |
| 5,222,345 | 6/1993 | Riley | 52/717.03 X |
| 5,230,180 | 7/1993 | Tweedt et al. | 52/211 X |
| 5,247,769 | 9/1993 | Becker | 52/506.06 |
| 5,326,187 | 7/1994 | St. Marie et al. | 52/738.1 X |

FOREIGN PATENT DOCUMENTS

| | | | |
|---|---|---|---|
| 2596450 | 10/1987 | France | 49/504 |
| 2458315 | 6/1976 | Germany | 49/501 |
| 4131460 | 4/1993 | Germany | 52/716.1 |
| 619028 | 3/1949 | United Kingdom | 52/717.01 |
| 2110262 | 6/1983 | United Kingdom | 52/204.2 |
| 2197015 | 5/1988 | United Kingdom | 52/204.1 |
| 2217360 | 10/1989 | United Kingdom | 52/204.2 |
| 2234993 | 2/1991 | United Kingdom | 52/204.2 |

*Primary Examiner*—Wynn E. Wood
*Assistant Examiner*—Laura A. Saladino
*Attorney, Agent, or Firm*—Carnes, Cona, and Dixon

[57] ABSTRACT

The present invention provides for an angle iron cover to be removably secured to an angle iron. This angle iron cover includes a first wall, a second wall and a securing mechanism for securing the cover to the angle iron. This design and configuration of the angle iron cover will provide for an aesthetically pleasing view in areas where openings are located in brick buildings and will also shield any rusting that can occur with the angle iron from the view of sight.

14 Claims, 2 Drawing Sheets

"PRIOR ART"

ANGLE IRON COVER

BACKGROUND OF THE INVENTION

1. Field of the Invention

The present invention relates generally to an angle iron cover apparatus and more particularly to an angle iron cover that is removably attachable to a conventional angle iron that is used above brick openings.

2. Description of the Prior Art

The construction of residential and commercial buildings has been booming over the past several years. The demand for good quality residential and commercial housing requires that the building is not only structurally sound, but also aesthetically pleasing. When building brick dwellings, angle irons are used for the supports in the area of any level openings (i.e. door way, window area, etc.). Once these angle irons are in placed, at least a side of the angle iron is exposed. This exposed portion, once exposed to outside elements, become rusted in time. This rusting of the angle iron provides for an unsightly and displeasing site in the area of the window and door ways. Devices have been designed to provide for more attractive door way or window. Such a device is disclosed in U.S. Pat. No. 3,130,455 issue to Borlenghi. Borlenghi discloses a door frame of plastics for room doors which includes a webb section and a pair of wings. The web section includes a step. Thereby, this apparatus works well with a door frame, however it does teach away from using this device with an angle iron due to the step portion.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a cover device for an angle iron. The cover device of the present invention includes a first wall, a second wall, and a securing means. The first wall, includes a first end and a second end. This first wall covers the area of the exposed angle iron. The second wall, which is perpendicular to the first end, partially or completely covers the back portion of the angle iron. The securing means is attached to the second end of the first wall to provide a means of retaining the cover on to the conventional angle iron.

Thus, when the cover is attached to the device, it will provide for the exposed surface(s) to be covered. This covering will provide for an aesthetically pleasing look over the angle iron. With this cover, the angle iron is camouflage and the rusting (if it occurs) is hidden via the first wall and/or the securing means of the cover.

Accordingly, it is the object of the present invention to provide for a cover device to be used with a conventional angle iron.

It is another object of the present invention to provide for a cover device that will provide a quick and efficient means of hiding any rusting that may occur with an angle iron as well as add to the attractiveness and beauty of any opening (garage door openings, window, etc.) that uses an angle iron.

A final object of the present invention, to be specifically enumerated herein, is to provide an angle iron cover in accordance with the preceding objects and which will conform to conventional forms of manufacture, be of simple construction and easy to use so as to provide a device that would be economically feasible, long lasting and relatively trouble free in operation.

Although angle irons have been used for several years, a device to cover the angle irons has not been disclosed. This angle iron cover of the present invention is sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
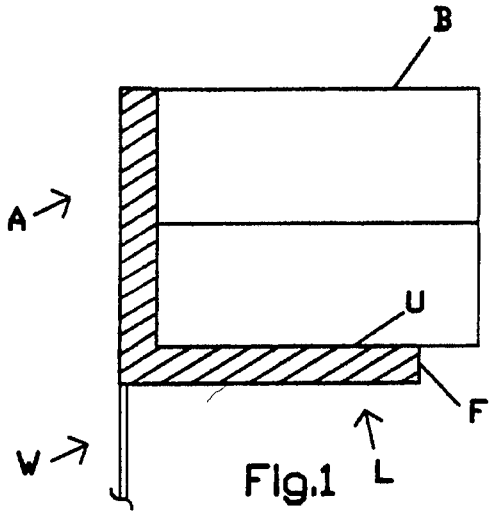
FIG. 1 is a side view of a conventional angle iron.

A conventional angle iron is illustrated in FIG. 1. As illustrated in FIG. 1, the angle iron A, has a L-shape including an upper flange and lower flange, both illustrated but not labeled, and includes a front F, a lower surface L and an upper surface U. The lower flange includes the lower and upper surface while the upper flange includes an inner surface (illustrated, but not labeled) and an exterior surface (illustrated, but not labeled). In use, the upper surface U will maintain a plurality of bricks B. As seen, the brick will contact the inner surface of the upper flange. The lower surface L will be exposed via the window W while the front F and lower surface L, will be visual from the front view of the angle iron A. As seen in this figure, the exposed area of the angle iron (front F and lower surface L) will be seen once an individual looks upwards. This front and lower surface of the angle iron will become exposed to the outdoor elements, and as such will become rusty in time. This rusting is an extremely hideous site.

Figure 3:
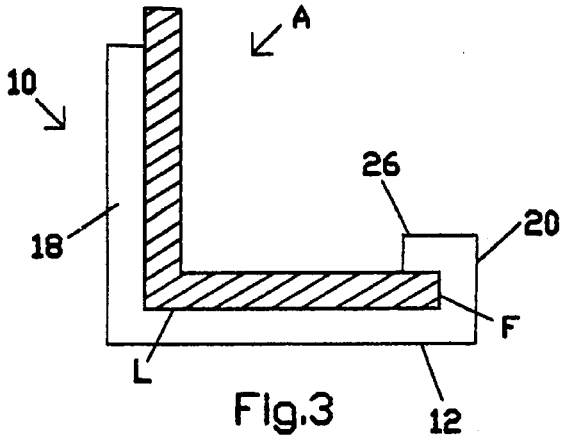
FIG. 3 is a side view of the cover of the first embodiment attached to the conventional angle iron illustrated in FIG. 1.
Figure 2:
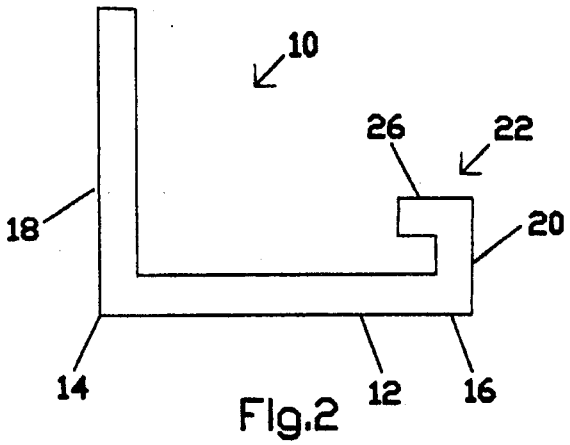
FIG. 2 is a side first embodiment of the cover of the present invention.

The present invention will be used to cover the lower surface L and the front F of the conventional angle iron A so as to provide for an aesthetically pleasing viewing area. The first embodiment for the cover 10 which is used with the angle iron, such as the one illustrated in FIG. 1, is illustrated in further detail in FIGS. 2 and 3. As seen in these figures, the first embodiment of the cover 10 includes a first wall 12. This first wall 12 has a first end 14 and a second end 16. A second wall 18 is attached perpendicularly to the first end 14 of the first wall. This second wall 18 can be any desired height so as to either completely cover the back wall of the angle iron or to partially cover the back wall of the angle iron (illustrated in FIG. 3). A securing means 22 is attached to the second end of the first wall. This securing means consists of a third wall 20 that is attached perpendicularly to the second end of the first wall 12. The securing means 22 also includes a fourth wall 26 that extends perpendicularly from the third wall and extends towards the second wall 18.

To use this first embodiment (see FIG. 3), the front F of the angle iron A is merely snapped into place (secured) on to the cover 10 by way of the securing means 22. This will provide for the lower surface L to be covered via the first wall 12 and for the front F to be covered via the third wall 20. The back of the angle iron in this figure is merely partially covered. This first embodiment will provides for the cover to quickly and easily be secured onto the angle iron. As seen in this embodiment, the first wall 12 will contact the lower surface L of the angle iron A. The securing means 22 will contact and engage the front surface F and partially contact and engage the upper surface U. This design and configuration enables easy installation of the cover 10 to the angle iron. The angle iron can now be used and installed as desired to provide for the exposed surface to be covered to render an aesthetically pleasing product.

Figure 4:
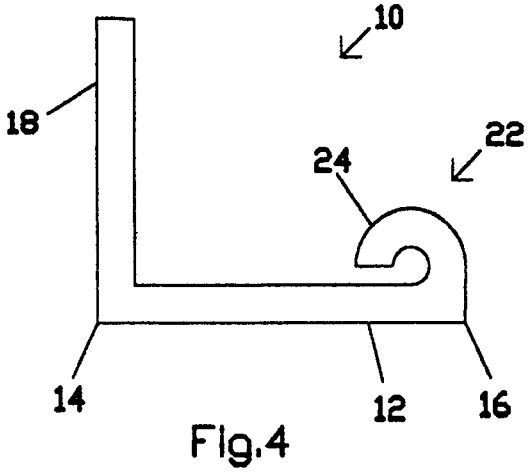
FIG. 4 is a side view of a second embodiment of the angle iron cover of the present invention.

The securing means of the first embodiment of the present invention can be altered slightly to provide for a second embodiment of the present invention. This second embodiment is illustrated in FIG. 4. As seen in this embodiment this figure, the cover 11, includes a first wall 12 and a second wall 18 that are similar in design and functionality as with the first embodiment. The first wall 12 includes a first end 14 and a second end 16. The securing means 22 is attached to the second end of the first wall. The securing means 22 consists of an arcuate member 24. This design operates in the same fashion as in the first embodiment. Hence the securing means is snapped onto the front end of the conventional angle iron. The arcuate member 24 is adapted to receive and maintain the front of the conventional angle iron.

Figure 5:
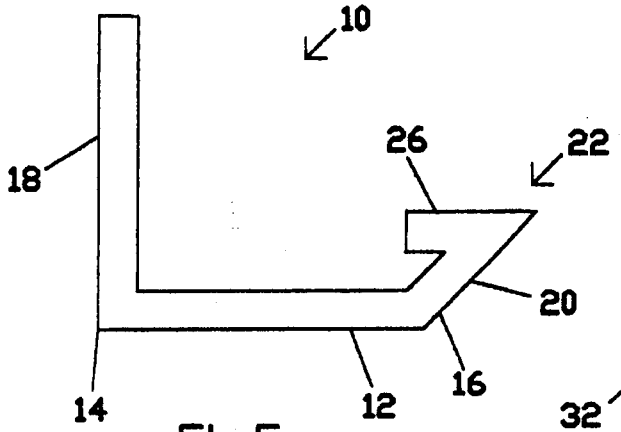
FIG. 5 is a side view of a third embodiment of the angle iron cover of the present invention.

This securing means 22 can be altered again to provide for a third embodiment of the present invention. This third embodiment is illustrated in further detail in FIG. 5. As seen in this figure the third embodiment for the cover 10 includes a first wall 12 and a second wall 18. The first wall has a first end 14 and a second end 16. The securing means 22 includes a third wall 20 that is attached to the second end 16 at an acute angle. The securing means 22 further includes a fourth wall 26 that extends outwardly from the third wall and towards the first wall. The design and configuration of the securing means 22 of the fourth embodiment is similar in design to the securing means 22 of the first and second embodiments, and as such this fourth embodiment operates and functions in the same manner as with the first embodiment. Hence, the front of the conventional angle iron will be received via the securing means 22. This will provide for the first wall 12 to and the third wall 20 to cover the exposed lower surface and front of the conventional angle iron.

Figure 6:
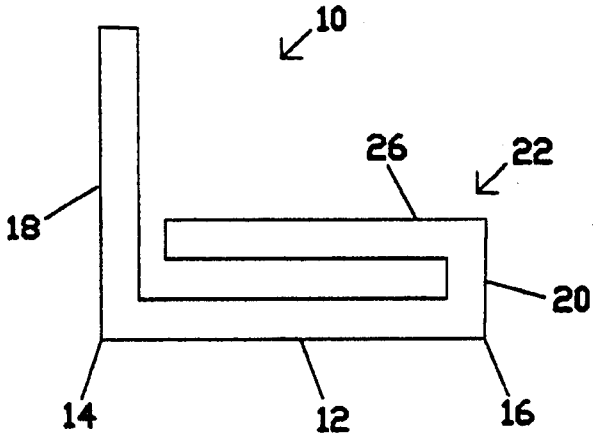
FIG. 6 is a side view of a fourth embodiment of the angle iron cover of the present invention.

The securing means in the above-described first and third embodiments can be altered to provide for a fourth embodiment of the present invention. This fourth embodiment is illustrated in further detail in FIG. 6. As seen in this fourth embodiment the cover 10 includes a first wall 12 having a first end 14 and a second end 16. A second wall 18 is attached to the first end 14 of the first wall. A securing means 22 is affixed at the second end of the first wall. This securing means 22 includes a third wall 20 that is secured to the second end 16 of the first wall 12. This third wall can be attached at any angle (illustrated in figure as being perpendicularly attached). A fourth elongated wall 26 is secured to the third wall to provide for the fourth wall 26 to be adapted to extend across the entire upper surface of the angle iron once the angle iron is in place.

In order to use this fourth embodiment of the present invention, the lower and upper surfaces of the angle iron are merely slid through the securing means 22 of the cover 10. This will provide for the upper surface, lower surfaces, and front to be completely covered via the cover 10.

Figure 7:
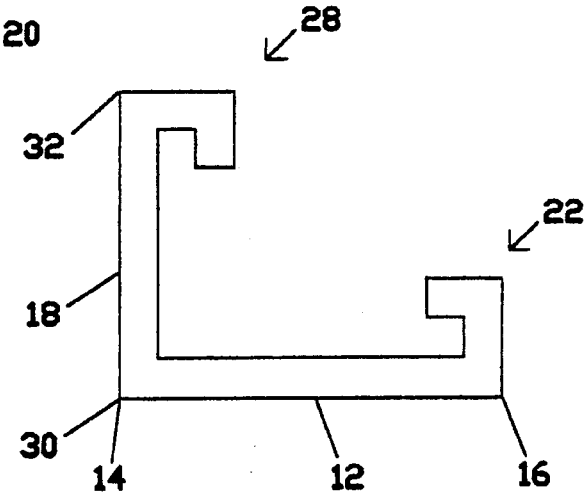
FIG. 7 is a side view of a fifth embodiment of the angle iron cover of the present invention.

All of the embodiments described above can be altered to include a second securing means 28. This alteration is illustrated in further detail in FIG. 7. As seen in this drawing the cover consists of a first wall 12 which includes a first end 14 and a second end 16. The second wall 18 also includes a first end 30 and a second end 32. Secured to the second end 16 of the first wall is a first securing means 22 and attached to the second end 32 of the second wall 18 is a second securing means 28. This second securing means can be designed and configures as any of the above described embodiments for the securing means. The use of two securing means (22 and 28) provides an added means of maintaining the cover on the angle iron when working with the conventional angle iron. This second securing means 28 will guarantee that the cover will remain in place when the angle iron is utilized.

Figure 8:
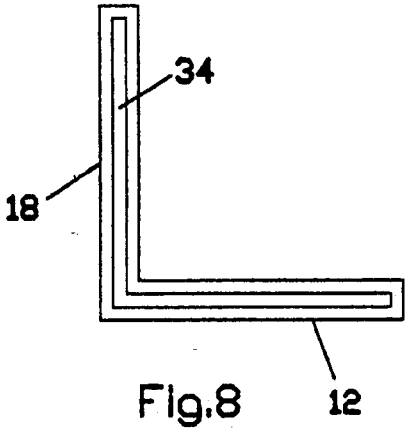
FIG. 8 is a side view of a sixth embodiment of the angle iron cover of the present invention.

The cover can also be altered to include yet another embodiment of the present invention. This embodiment is illustrated in further detail in FIG. 8. As seen in this embodiment the cover consists of a first wall 12 and a second wall 18. Extending through the first and second walls is a L-shape groove 34. This design and configuration will permit for the angle iron to slide into the groove and provide for all surfaces to be shielded via the present invention. This embodiment incorporates the combination of utilizing a first securing means and a second securing means that are designed as illustrated in the fourth embodiment (see FIG. 6).

The material used for fabricating the cover in the above-described embodiments can be any durable, anti-rusting material such as plastic, aluminum or vinyl. Additionally, it is noted that the first wall, second wall, first securing means and/or second securing means are integral components. The use of this cover in combination with a conventional angle iron provide for an aesthetically pleasing viewing area.

The cover 10 illustrated and described in the above embodiments is designed to be utilized with an angle iron which is used in brick dwellings for the supports in the area of any level opening, such as door ways, windows, or the like. The cover 10 is configured to be easily installed and secured onto the angle iron. Once attached to the angle iron, the angle iron can be used accordingly. Bricks can be installed onto the upper surface of the angle iron and the securing means of the cover will not be obstructive to the brick. This will render a cover which will provide for an aesthetically pleasing product and may even deter the angle iron from rusting. The interior area of the walls of the cover is also designed to contact the outer walls of the angle iron, as clearly seen in FIG. 3. Additionally, the interior area of each embodiment for the securing means 22 is designed to contact and engage the upper surface and front surface of the angle iron A. This will provide for the cover 10 to be securely affixed onto the angle iron A.

As seen from the various figures, the second end of the cover will be maintained on the angle iron via the securing means 22. Inherently, the first end will include the added support of the wall W. Thereby, once the angle iron is installed with the cover attached thereto, the angle iron will not be visually seen.

While the invention has been particularly shown and described with reference to an embodiment thereof, it will be understood by those skilled in the art that various changes in form and detail may be made without departing from the spirit and scope of the invention.

I claim:

1. A cover used in combination with an angle iron which is positioned in an upright position and is used above brick openings, having a L-shape and including an upper surface for receiving bricks, a front surface which is exposed and visual, and a lower surface which is exposed and visual, said cover comprising:

a first wall having a first end and a second end;

a second wall is perpendicularly attached to said first end of said first wall;

a first securing means is attached to said second end of said first wall; and said cover is removably secured to said angle iron and is snapped onto said angle iron to provide for said securing means to receive, contact, engage and maintain said front surface and partially contact and engage said upper surface of said angle iron and providing said first wall to contact, shield and cover said lower surface of said angle iron and said securing means contacts, shields and covers said front surface of said angle iron and partially contacts, shields and covers said upper surface of said angle iron.

2. A cover used in combination with an angle iron as in claim 1 wherein said first securing means includes a third wall attached to said second end of said first wall and a fourth wall attached to and extending from said third wall, said fourth wall extends towards said second wall, and said third wall contacts said front surface of said angle iron, said fourth wall contacts said upper surface of said angle iron, and said fourth wall is adapted to receive bricks from a brick dwelling.

3. A cover used in combination with an angle iron as in claim 2 wherein said third wall is attached perpendicularly to said second end of said first wall of said first wall.

4. A cover used in combination with an angle iron as in claim 2 wherein said third wall is attached to said second end at an acute angle.

5. A cover used in combination with an angle iron as in claim 1 wherein said first securing means is an arcuate member.

6. A cover used in combination with an angle iron as in claim 1 wherein said second wall includes a first end and a second end and a second securing means is attached to said second end of said second wall and said first end of said second wall is attached to said first end of said first wall and said second securing means partially covers an inner surface of said angle iron.

7. A cover used in combination with an angle iron as in claim 6 wherein said first securing means is a first arcuate member and said second securing means is a second arcuate member.

8. A cover used in combination with an angle iron as in claim 6 wherein said first securing means includes a third wall attached to said second end of said first wall and a fourth wall is attached to and extending from said third wall, and said fourth wall extends towards said second wall and said second securing means includes a fifth wall attached to said second end of said second wall and a sixth wall attached to and extending from said fifth wall and said sixth wall extends towards said first wall.

9. A cover used in combination with an angle iron as in claim 8 wherein said third wall is attached perpendicularly to said first wall.

10. A cover used in combination with an angle iron as in claim 8 wherein said third wall is attached at an acute angle to said first wall.

11. A cover used in combination with an angle iron as in claim 1 wherein said cover is fabricated from an anti-rusting material.

12. A cover in combination with an angle iron which is positioned in an upright position and is used above brick openings, having a L-shape and including an upper surface for receiving bricks, a front surface which is exposed and visual, and a lower surface which is exposed and visual, said cover comprising:

a first wall having a first end and a second end;

a second wall is perpendicularly attached to said first end of said first wall;

a first securing means is attached to said second end of said first wall; and said cover is removably secured to said angle iron and is snapped onto said angle iron to provide for said securing means to receive, contact, engage and maintain said front surface and entirely contact and engage said upper surface of said angle iron and to expose an inner surface of said angle iron and providing said first wall to contact, shield and cover said lower surface of said angle iron and said securing means contacts, shields and covers said front surface of said angle iron and entirely contacts, shields and covers said upper surface of said angle iron for enabling quick and easy installation of said cover.

13. A cover in combination with an angle iron as in claim 12 wherein said cover is fabricated from an anti-rusting material.

14. A cover in combination with an angle iron which is positioned in an upright position and is used above brick openings, having a L-shape and including an upper surface for receiving bricks, a front surface which is exposed and visual, and a lower surface which is exposed and visual, said cover comprising:

a first wall having a first end and a second end;

a second wall is perpendicularly attached to said first end of said first wall and includes a first end and a second end;

a first securing means is attached to said second end of said first wall;

a second securing means is attached to said second end of said second wall and said first end of said second wall is attached to said first end of said first wall;

said second securing means contacts said first securing means to provide for a groove to exists for enabling said angle iron to slide into said groove; and said cover is removably secured to said angle iron and is slid into said groove to provide for said first securing means to receive, contact, engage and maintain said front surface and entirely contact and engage said upper surface of said angle iron and said second securing means receive, contact, engage and maintain an inner surface and an upper edge of said angle iron to provide for all surfaces of said angle iron to be completely covered.

* * * * *